United States Patent [19]

Monte

[11] 4,377,210

[45] Mar. 22, 1983

[54] FUEL TRUCK FIRE ESCAPE MECHANISM

[76] Inventor: Anthony J. Monte, 47660 Bluebird, Utica, Mich. 48087

[21] Appl. No.: 236,100

[22] Filed: Feb. 20, 1981

[51] Int. Cl.[3] ..... A62C 35/12

[52] U.S. Cl. ..... 169/62; 200/61.55; 180/282

[58] Field of Search ..... 169/62, 66, 54, 56, 169/61, 52, 24, 26; 200/52 A, 61.45 R, 61.52, DIG. 29; 180/271, 282

[56] References Cited

U.S. PATENT DOCUMENTS 2,986,614 5/1961 Minch ..... 200/61.52

3,465,827 9/1969 Levy et al. ..... 169/62

*Primary Examiner*—Joseph J. Rolla

*Assistant Examiner*—Kenneth Noland

*Attorney, Agent, or Firm*—Peter A. Taucher; John E. McRae; Nathan Edelberg

[57] ABSTRACT

In a fuel transport vehicle, the improvement comprising a fire suppressant mechanism located between the cab area of the vehicle and the vehicle fuel storage tank. Should the vehicle jackknife or otherwise accidently capsize onto its side an automatic valve device causes the fire-suppressant mechanism to discharge a fire suppressant chemical onto the ground or road surface between the driver-occupied cab and the fuel cargo; thereby minimizing the possibility that spilled fuel will ignite and produce a flame in the area immediately adjacent the cab. The added margin of safety against burn injury will provide the driver with a stepping-stone path of escape from the fire zone. A manual override control for the automatic valve will enable the valve to be operated in the event of a fire originating from careless handling of fuel or a malfunction of the automatic valve control.

6 Claims, 4 Drawing Figures

FUEL TRUCK FIRE ESCAPE MECHANISM

BACKGROUND AND SUMMARY OF THE INVENTION

Existing tractor-trailer units for transporting flamable fuel such as the military M52 tractor and M131 trailer, are equipped with various fire suppressant mechanisms for suppressing fires that may be generated in the electrical components and fuel pumping systems mounted on the trailer. However, there is no automatic fire protection mechanism for protecting the driver of the tractor against flames due to fuel spillage in the event that tractor-trailer unit should accidently overturn. The present invention is directed to this type of fire suppressant mechanism. The mechanism is designed as a relatively low cost, compact, automatic, fail-safe system.

The invention described herein may be manufactured, used, and licensed by or for the Government for governmental purposes without payment to me of any royalty thereon.

IN THE DRAWING

Figure 1:
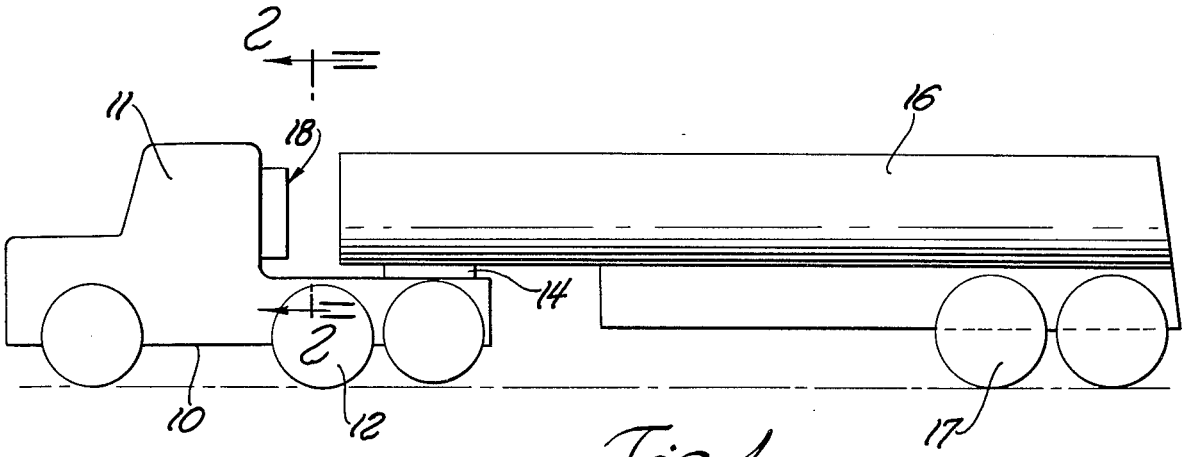
FIG. 1 is a side elevational view of a tractor-trailer unit having one embodiment of my invention incorporated therein.

Referring in greater detail to FIG. 1 there is shown a tractor-trailer unit comprising a tractor 10 having ground wheels 12 and a fifth wheel 14 for mounting the front end of a tanker trailer unit 16 that is equipped with ground wheels 17. The tanker unit 16 is an elongated hollow container equipped with one or more internal partitions that define compartments for fuel to be transported on highways or off the road, as for example in the support of military operations. Commonly the trailer unit 16 would have a capacity of 5000 gallons contained within three separate compartments.

Figure 2:
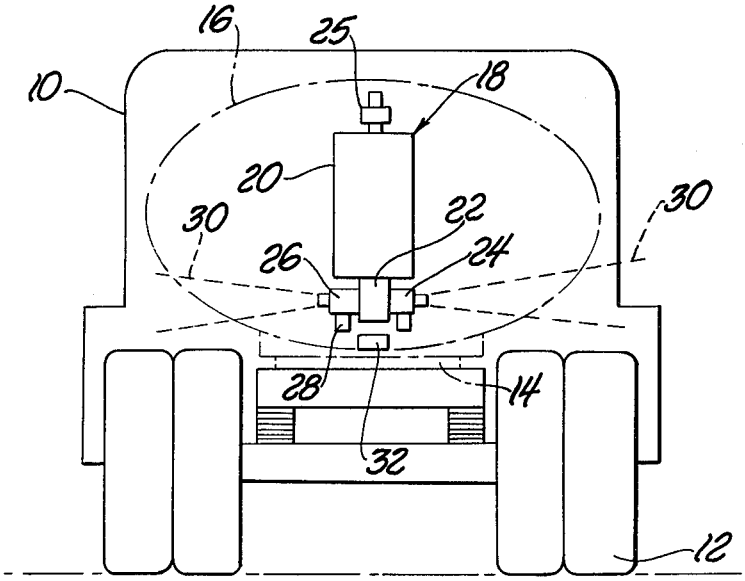
FIG. 2 is a view looking forwardly along line 2—2 in FIG. 1.
Figure 3:
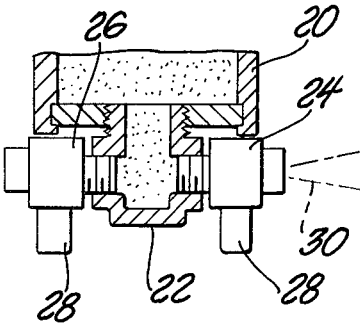
FIG. 3 is an enlarged fragmentary view of a portion of the structure shown in FIG. 2.

FIG. 1 shows in block form a fire suppressant mechanism 18 adapted to discharge dry chemical suppressant to either side of the vehicle in the event that the tractor-trailer unit should be accidentally turned on its side. Mechanism 18 can be mounted on the rear wall of cab 11 or the front wall of trailer 16; as shown it is mounted on the cab. The structure of mechanism 18 is shown in some what greater detail in FIG. 2. As there shown, the mechanism comprises an upright fire-suppressant bottle or cylinder 20 having a discharge fitting 22 at its lower end for mounting a right-oriented solenoid valve 24 and a left-oriented solenoid valve 26. As shown in FIG. 3, fitting 22 may be threaded into the lower end of container 20, whereas each solenoid valve 24 or 26 may be screwed into a side opening or port in fitting 22. Each valve 24 or 26 is provided with an electrical solenoid 28 which, when electrically energized, will move the internal flow throttling element to its open position, thereby enabling chemical fire suppressant material to be discharged from the valve in the pattern designated by numeral 30. It will be understood that normally both valves 24 and 26 are closed; a given solenoid 28 will be energized only when its desired to discharge the dry chemical, as in the case of an accident when the tractor-trailer unit jackknifes or otherwise comes to rest on its side.

The dry fire suppressant chemical may be any conventional chemical used for fire suppressant purposes, for example finely divided sodium bicarbonate or potassium chloride. Various additives such as metallic stearates or silicones are commonly incorporated into the powders to improve their flowability and water repellency characteristics. The dry chemical is pressurized within container 20 to approximately 330 p.s.i. charging pressure in the upper end of the container, as by means of an inert gas such as dry nitrogen or carbon dioxide charged into the container through a check valve 25 at the upper end of the container. A pressure gage, not shown, may be mounted on the top wall of the container to provide continuous indication of the pressure within the container. When valve 24 or 26 is opened the pressurized chemical is caused to flow through the opened valve to the area alongside the tractor-trailer unit.

Figure 4:
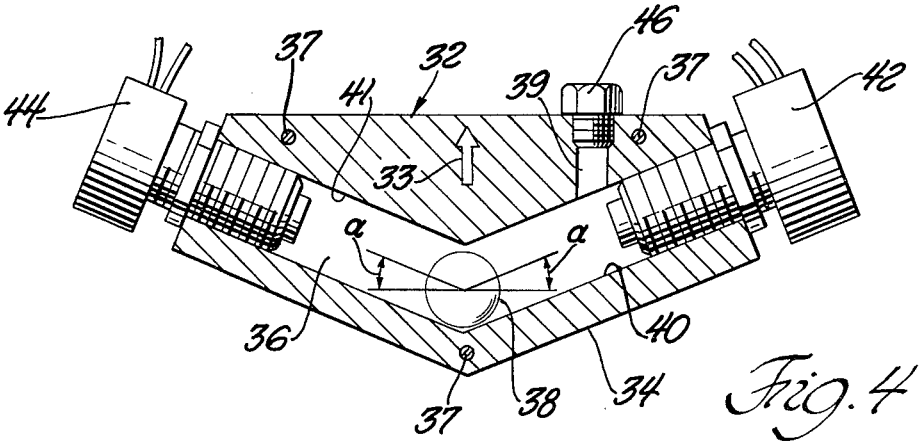
FIG. 4 is an enlarged sectional view of a switch mechanism used in the FIG. 2 system.

The solenoids for valves 24 and 26 may be controlled by an electrical switch means 32, shown in FIG. 4 as comprising a central housing 34 having an internal V-shaped track 36 that includes a right leg 40 and a left leg 41. The track is of slightly greater cross-sectional area than a ball 38 contained therein. With the trailer in a normal upright attitude gravitational forces will cause ball 38 to be located at the apex area of the V as shown in FIG. 4. Should the tractor-trailer unit accidentally tip over so that it is lying on its right side the ball will roll along leg 40 of the internal track into contact with a magnetic proximity switch 42 that is screwed or otherwise attached to housing 32 at one end of the track. A second similar proximity switch 44 is located at the other end of the V-shaped track for engagement by ball 38 should the trailer accidentally overturn onto its left side. Proximity switches 42 are/or may be conventional commercial items obtainable from known switch manufacturers, e.g. Dynasciences Corp. of Chatsworth Calif. Ball 38 is formed of a ferro-magnetic material such that when the ball engages the inner end of the proximity switch a magnetically-operated switchblade within the switch casing is snapped over to the circuit-closed condition.

It will be understood that switch 42 is connected between a source of electrical energy on the vehicle and solenoid 28 for valve 24, such that when the vehicle overturns onto its right side ball 38 contacts switch 42, whereby valve 24 is opened to discharge dry chemical suppressant onto the ground in the area between trailer unit 16 and the cab portion of tractor 10. Should trailer 16 split open to spill fuel onto the ground there is a possibility that the spilled fuel will ignite. The chemical discharged by valve 24 will act as a barrier against the spread of a flame from the vicinity of trailer 16 along the ground toward the cab. The driver will thus enjoy a measure of protection for allowing time to escape or await assistance. If the vehicle overturns on its other side ball 38 will contact switch 44 for thus energizing the solenoid associated with valve 26. The valve solenoids are selectively energized so that the dry chemical is in each case directed toward the ground rather than into the atmosphere.

Each leg of track 36 is inclined at an angle a that is approximately twenty degrees so that the ball does not roll from its FIG. 4 position until the trailer has a lateral tilt of at least twenty degrees; the inclination angel could be greater than 20 degrees if found necessary to prevent inadvertant switch actuation. Also, the internal track 36 may be partially filled with oil or other viscous liquid having a damping effect on ball movement away from its normal position shown in FIG. 4. The oil may be introduced through a port closed by a fitting plug 36, leaving a small vacant space 39 below the plug for thermal expansion. Screws 37 may be used to secure mechanism 32 in an upright attitude, as indicated by arrow 33, on a non-illustrate mounting plate. Mechanism 18 will be secured to the mounting plate directly above the switch mechanism, preferable at a location on the longitudinal centerline of the vehicle.

The control switch means shown in FIG. 4 may be supplemented with a manual switch means in the tractor cab area should it be desired to provide for manual actuation of valves 24 and 26, as for example in event of malfunction of the FIG. 4 switch or a fire situation occurring without overturnment of the trailer. The quantity of chemical fire suppressant within container 20 may be varied according to space available at the rear end of the tractor and/or the expected flame spread velocity. No more than 30 pounds of dry chemical would in most situations be required.

I wish it to be understood that I do not desire to be limited to the exact details of construction shown and described for obvious modifications will occur to a person skilled in the art.

I claim:

1. In a flammable fuel transport vehicle comprising a cab for the driver and a fuel-containing tank behind the cab: the improvement comprising a fire suppressant mechanism located in the space between the cab and tank for covering the ground area alongside said space in the event that the vehicle should be accidentally turned on its side; said fire suppressant mechanism comprising an upright container for pressurized fire suppressant chemical, a first solenoid valve connected with the container for discharging the chemical toward the area at the right side of the vehicle, a second solenoid valve connected with the container for discharging the chemical toward the area at the left side of the vehicle, and electric switch means responsive to lateral tilting movements of the vehicle for selectively energizing the valve solenoids so that when the vehicle is lying on its right side only the first valve is opened, and when the vehicle is lying on its left side only the second valve is opened.

2. The improvement of claim 1 wherein the electric switch means comprises a central housing defining an internal V-shaped track, a ferro-magnetic ball located in the track for normal positionment at the apex area of the V, and first and second magnetic proximity switches mounted on the housing at opposite ends of the V-shaped track, whereby a given sidewise tilting movement of the vehicle in one direction causes the ball to roll along the track into contact with the first switch, and a given sidewise tilting movement of the vehicle in the opposite direction causes the ball to roll along the track into contact with the second switch.

3. The improvement of claim 2 wherein each leg of the V-shaped track has a normal inclination of approximately twenty degrees.

4. The improvement of claim 3 wherein the internal track is filled with a viscous liquid that has a dampening effect on ball movement away from the apex area of the track.

5. The improvement of claim 1 wherein the fuel transport vehicle is a tractor-trailer unit; the fire suppressant mechanism being mounted on the rear face of the tractor cab on the longitudinal centerline of the vehicle; said first solenoid valve having its discharge opening arranged to direct fire suppressant chemical substantially directly downward when the tractor-trailer unit is accidentally turned on its right side; said second solenoid valve having its discharge opening arranged to direct fire suppressant chemical substantially directly downward when the tractor-trailer unit is accidentally turned on its left side.

6. The improvement of claim 5 wherein the solenoid valves are connected to the upright container by means of a fitting (22) threaded onto the container bottom wall; said fitting having flow openings in its side surfaces adapted to mount respective ones of the solenoid valves.

* * * * *